United States Patent [19]

Tsukamoto et al.

[11] 4,183,146

[45] Jan. 15, 1980

[54] PROCESS FOR SIMULTANEOUSLY DRYING MECHANICAL WOOD PULP AND IMPROVING MECHANICAL STRENGTH AND BRIGHTNESS OF THE PULP

[75] Inventors: Haruo Tsukamoto; Kazuo Koide; Yuzo Okazaki; Isao Yamada, all of Tokyo, Japan

[73] Assignee: Oji Paper Co., Ltd., Tokyo, Japan

[21] Appl. No.: 883,208

[22] Filed: Mar. 3, 1978

[30] Foreign Application Priority Data

Jul. 19, 1977 [JP] Japan ..... 52/85612

[51] Int. Cl.[2] ..... F26B 7/00

[52] U.S. Cl. ..... 34/13.8; 134/30

[58] Field of Search ..... 34/12, 13.4, 13.8, 13; 134/30

[56] References Cited

U.S. PATENT DOCUMENTS

| | | | |
|---|---|---|---|
| 3,069,784 | 12/1962 | Aldred et al. | 34/13.8 |
| 3,770,575 | 11/1973 | Ball | 34/13.8 |

*Primary Examiner*—John J. Camby

*Attorney, Agent, or Firm*—Armstrong, Nikaido, Marmelstein & Kubovcik

[57] ABSTRACT

Disclosed is a process for simultaneously drying mechanical wood pulp and improving the mechanical strength and brightness of the wood pulp by mixing mechanical wood pulp with an aqueous solution of at least one sulfonating compound, the resultant mixture having a dry solid consistency of 20 to 50% of the wood pulp, based on the weight of said mixture and; bringing the mixture into contact with a heating gas having a temperature higher than 100° C. to cause the dry solid consistency of the wood pulp in the mixture to be increased to a range of from 65 to 90% by weight.

11 Claims, No Drawings

PROCESS FOR SIMULTANEOUSLY DRYING MECHANICAL WOOD PULP AND IMPROVING MECHANICAL STRENGTH AND BRIGHTNESS OF THE PULP

The present invention relates to a process for simultaneously drying mechanical wood pulp and improving the mechanical strength and brightness of the pulp. More particularly, the present invention relates to a process for simultaneously drying mechanical wood pulp and increasing the mechanical strength and brightness of the pulp by treating it with a sulfonating agent.

At present in the pulp and paper industry it is strongly desired to reduce the consumption of the present wood resources and the energy used in the production of wood pulp, and to minimize the environmental pollution derived from the process for producing wood pulp. Concerning the above-mentioned wood resource, it is known that the demand for paper is expected to increase yearly, whereas the resources of wood chips for producing wood pulp is becoming less year after year. Under these circumstances, it is necessary to produce wood pulp from wood chips in a yield as high as possible. In order to satisfy this requirement, it is desirable to produce mechanical wood pulp rather than chemical wood pulp. However, this has disadvantages in that the mechanical strength and the maximum brightness, which can be obtained under a normal bleaching condition, of mechanical wood pulp are poorer than those of the chemical wood pulp, and the brightness of the mechanical wood pulp tends to decrease with the lapse of storage time. Accordingly, in order to increase the usefulness of mechanical wood pulp, it is necessary to eliminate the above-mentioned disadvantages.

In order to increase both the mechanical strength and the brightness of the mechanical wood pulp, a number of processes have been suggested using various chemical agents for treating the pulp. For example, a process is disclosed in Foote W. J., PULP AND PAPER MAGAZINE OF CANADA, Vol. 56, No. 12, Page 124(1955), in which process mechanical wood pulp is treated with an aqueous solution of sodium hydroxide. This process is effective for improving the mechanical strength of the mechanical wood pulp to a certain degree, in that the higher consistency of the sodium hydroxide in the treating solution, the higher the mechanical strength of the resultant wood pulp. However, this method has disadvantage in that the increase in the consistency of the sodium hydroxide in the treating solution results in a decrease in the brightness of the treated wood pulp.

Becher J. J. TAPPI, Vol. 54, page 104(1976), discloses a process for treating groundwood, produced from hardwood, with an alkali solution at an elevated temperature for a very short time. This method is referred to as the Jet-alkali method, and is effective for increasing the mechanical strength of the mechanical wood pulp. In this method, the groundwood is suspended in a dry solid consistency of from 4 to 5% by weight in an aqueous solution of sodium hydroxide and treated with the solution at a temperature of 110° C., for about 6 seconds. This method is effective for increasing the mechanical strength of the mechanical wood pulp. However, the use of the sodium hydroxide as the treating agent results in a decrease in the brightness of the mechanical wood pulp and also in a decrease of from 2 to 5% by weight in the yield of the mechanical wood pulp.

In order to improve both the mechanical strength and brightness of mechanical wood pulp, attempts have been made to treat the wood pulp with an oxidizing agent such as ozone, hydrogen peroxide and sodium chlorite alone or together with the above-mentioned sodium hydroxide. This method is effective for remarkably increasing the mechanical strength of the mechanical wood pulp, in that the larger the amount of the oxidizing agent applied to the wood pulp the higher the mechanical strength of the treated wood pulp. However, this method is disadvantageous in that the cost of the oxidizing agent to be used for the method is high, which results in the operation cost of the method being undesirably high. This method is also disadvantageous in that the reaction of the oxidizing agent with the mechanical wood pulp causes lignin to be removed from the pulp and the removal of lignin results in a reduction in the yield of the treated mechanical wood pulp.

In another method for increasing both the mechanical strength and the brightness of the mechanical wood pulp, the wood chip or mechanical wood pulp is treated with an aqueous solution of a sulfonating agent, such as sodium sulfite or sodium hydrogensulfite. When applied to the mechanical wood pulp, this method is referred to as the post-sulfonation method. For example, Dahm, PAPERI JA PUU, Vol. 48, No. 10, Page 591 (1966), discloses a method in which a refined wood pulp is suspended in a low dry solid consistency of 2% thereof in an aqueous solution of a low consistency of 3% by weight of a sulfite and, then, treated with the sulfite solution at a temperature of 90° C., for from 1 to 3 hours. In this method, the sulfite is required to be used in a large amount of 150%, based on the dry solid weight of the wood pulp. Accordingly, the method is disadvantageous in that the amount of the treating agent to be applied to the wood pulp is very large and the treating time is very long.

In the above-mentioned conventional oxidizing and sulfonating methods, a low consistency of the mechanical wood pulp is suspended in a treating solution containing the treating agents in a low consistency. Accordingly, it is obvious that the above-mentioned oxidizing and sulfonating methods need a large amount of the treating agent and a long time to complete the treatment.

U.S. Pat. No. 3,492,199 discloses a method for simultaneous and rapid drying, and bleaching, of mechanical wood pulp by mixing an alkaline aqueous solution of hydrogen peroxide with mechanical wood pulp, and rapidly drying the mixture by way of flush drying at an elevated temperature. In this method, the reaction of the mechanical wood pulp with the hydrogen peroxide is effected in a high concentration of the wood pulp in a gaseous medium. Generally, the flush drying of the mechanical wood pulp at a high temperature results in a decrease in the brightness of the wood pulp. However, the use of the alkaline hydrogen peroxide solution in this method is effective to prevent the decrease in the brightness of the mechanical wood pulp during the flush drying process. In this case, it should be noted that a portion of the used hydrogen peroxide remains on the wood pulp after finishing the drying process. The remaining hydrogen peroxide gradually bleaches the dried wood pulp and, therefore, the brightne of the dried wood pulp gradually increases daily over a period of several days. However, it has been also observed that this method is sometimes slightly effective or not effective at all for improving the mechanical strength of the mechanical wood pulp.

Under the above-mentioned circumstances, it is strongly desired in the pulp and paper industry to provide a process effective for increasing both the mechanical strength and the brighteness of the mechanical wood pulp at low cost.

The object of the present invention is to provide a process for simultaneously drying mechanical wood pulp and improving the mechanical strength and brightness of the wood pulp, within a short time at a low cost.

The above-mentioned object can be attained by the process of the present invention, which comprises:

providing a uniform mixture of mechanical wood pulp, prepared by mechanically refining wood chips, and an aqueous solution of at least one sulfonating compound, the resultant mixture having a dry solid consistency of from 20 to 50% of said mechanical wood pulp, based on the weight of the mixture, and;

drying the mixture to a dry solid consistency of from 65 to 90% by weight of said mechanical wood pulp by bringing the mixture into contact with a heating gas having a temperature higher than 100° C.

In the drying step in the process of the present invention, the mechanical wood pulp, in a dry solid consistency of 20 to 50% by weight in the mixture, is sulfonated with the sulfonating compound, in a gaseous heating medium, at a high temperature. During the drying process, the mixture is sulfonated. Therefore, the consistencies of the mechanical wood pulp and the sulfonating agent in the mixture rapidly increase with the lapse of the drying time so that the sulfonation of the mechanical wood pulp can proceed uniformly and be completed within a short time. The resultant wood pulp has an improved mechanical strength and brightness. These effects of the process of the present invention can not be expected from any of the afore-mentioned conventional methods.

The preparation of the mixture of the mechanical wood pulp and the sulfonating agent solution is not limited to a special type of processes. Usually, the mechanical wood pulp is adjusted to a predetermined dry solid consistency by dewatering and then, the aqueous solution of the sulfonating agent is added to the precursory mixture to provide a dry solid consistency of 20 to 50% of the pulp, based on the total weight of the mixture. Otherwise, the mechanical wood pulp is mixed with the sulfonating agent solution to form a precursory mixture and, thereafter, the dry solid concentration of the wood pulp is adjusted to a desired value by dewatering the precursory mixture.

The mechanical wood pulp usable for the process of the present invention is not limited to a special group of wood pulp. Usually, the mechanical wood pulp may be stone-groundwood, refiner mechanical pulp (RMP), or thermomechanical pulp (TMP), produced from any hardwood chips and softwood chips, preferably, softwood chips.

The process of the present invention can be applied to mechanical wood pulp not only just after the refining process for the wood chips, but also after any processes for treating the wood pulp. The mechanical wood pulp is preferably mechanically fluffed or disintegrated into essentially separate or loosely agglomerated pulp fibers, before being fed to the process of the present invention.

The mechanical wood pulp to be fed to the process of the present invention preferably has a freeness of from 50 to 700 ml (Canadian Standard freeness). If the mechanical wood pulp has a freeness of from 300 to 700 ml (Canadian Standard freeness), it is preferable that after the process of the present invention is completed, the dried wood pulp is refined to provide a freeness of about 100 ml (Canadian Standard freeness) for the pulp.

The sulfonating compound may be selected from the group consisting of sulfurous acid and water-soluble sulfites, hydrogensulfites and pyrosulfites, preferably of alkali metals and alkaline earth metals, for example, sodium, potassium, calcium and magnesium.

The aqueous solution of the sulfonating compound preferably has a pH of from 2 to 13. When the pH is about 2, the aqueous solution contains a mixture of sulfurous acid and at least one hydrogensulfite. In the case of a pH of about 4, the aqueous solution contains at least one hydrogensulfite. In the case of a pH of from about 4 to about 9, the aqueous solution contains a mixture of one or more of hydrogensulfites or pyrosulfites and one or more of sulfites. When the pH is in a range of from about 8 to about 10, the aqueous solution contains essentially at least one sulfite. When the pH is in a range of from about 10 to about 13, the aqueous solution contains at least one sulfite and a buffer agent. The buffer agent may be selected from the group consisting of hydroxides, carbonates and hydrogencarbonates of, ammonium, alkali metals and alkaline earth metals, for example, sodium, potassium, calcium and magnesium.

The sulfonating compound is contained in the aqueous solution in a dry solid amount of 1 to 15%, preferably, 5 to 10%, based on the dry solid weight of the mechanical wood pulp to be treated. Also, it is preferable that the mixture to be dried contains the sulfonating compound in a dry solid consistency of from 20 to 50%, based on the weight of the mixture.

The heating gas to be brought into contact with the mixture has a temperature higher than 100° C., preferably, from 120° to 500° C. The contact of the mixture with the heating gas is maintained, usually under atmospheric pressure, until the mixture is dried to the dry solid consistency of from 65 to 90%, more preferably, 80 to 85%, by weight of the mechanical wood pulp, preferably, for a period not longer than 5 minutes, more preferably, 30 seconds to 1 minute.

The drying operation is not limited to a special type of drying operations. However, usually, the drying operation is effected in a hot air oven or a flush dryer. The heating gas is also not limited to a special type of gases. Usually, the heating gas may be selected from the group consisting of hot air, waste gas of a boiler and burnt heavy oil gas. However, the drying apparatus and the heating gas usable for the process of the present invention are preferably selected so that the volatile substances, for example, water, in the mixture can be uniformly evaporated from the mixture and uniformly discharged form the drying apparatus, and; so that the distribution of the dry solid consistency of the mechanical wood pulp in the mixture can be maintained uniform.

During the drying process, the pH of the mechanical wood pulp changes with the progress of the reaction of the sulfonating compound with the mechanical wood pulp. Generaly, the brightness of the dried mechanical wood pulp tends to become lower with an increase in the final pH of the dried wood pulp, whereas the mechanical strength of the mechanical wood pulp increase with the increase in the final pH of the dried wood pulp. Especially, if the final pH of the dried wood pulp becomes higher than 9.0, the brightness of the resultant wood pulp might be lower than that of the non-dried mechanical wood pulp. Therefore, it is preferable that the drying process be carried out so that the final pH of the dried mechanical wood pulp does not exceed 9.0. Also, in the case where the buffer agent is contained in a sulfonating compound solution, the brightness of the dried mechanical wood pulp becomes lower with an increase in the drying time. Accordingly, it is preferable that in the above-mentioned case, the drying process be finished within a short time. That is, in this case, it is preferable that the drying process be effected by using a flush drying apparatus.

As described above, the process of the present invention can improve both the mechanical strength and the brightness of the dried mechanical wood pulp. The increase in the brightness of the wood pulp is due to the reduction of colouring substances in the wood pulp by the sulfonating compounds. The increase in the mechanical strength of the wood pulp is due to the increase in the hydrophilic groups in the wood pulp, the hydrophilic groups being generated by the reaction between the wood pulp and the sulfonating compounds.

Further, features and advantages of the process of the present invention are illustrated by the examples set forth below, while are not intended to limit the scope of the present invention.

In the examples, the final pH of the dried mechanical wood pulp was determined by adding water to the dried mechanical wood pulp in a dry solid weight of 100 g, so as to provide an aqueous suspension of the mechanical wood pulp in a dry solid consistency of 5% by weight, and by measuring the pH of the suspension. The bulk density, breaking length, burst factor, brightness and opacity of the resultant mechanical wood pulp were determined, respectively, in accordance with the test methods of JIS P 8101, JIS P 8113, JIS P 8116, JIS P 8123 and JIS P 8138.

EXAMPLE 1

Pine wood chips were defibrillated in two stages by means of a disc refiner to prepare mechanical wood pulp having a Canadian Standard freeness of 410 ml. The wood pulp with a dry solid weight of 1000 g was uniformly impregnated with 2330 ml of an aqueous solution containing 5% of sodium sulfite and 1.0% of sodium hydroxide, based on the dry solid weight of the wood pulp. A mixture containing the wood pulp in a dry solid consistency of 30% by weight, and having a pH of 12.4, was obtained, 3330 g of the mixture were placed in a hot air oven and dried for 30 seconds by circulating hot air having a temperature of from 140° to 150° C. The dried wood pulp had a dry solid consistency of 65% by weight and a final pH of 9.2. The dry wood pulp was refined in a dry solid consitency of 15% by weight in water. The resultant wood pulp had a Canadian Standard freeness of 100 ml. The wood pulp was subjected to a hand sheet-forming process to produce testing sheets having a weight of 60 g/m$^2$. The properties of the resultant hand formed sheet are shown in Table 1.

EXAMPLE 2

The same procedures as those mentioned in Example 1 were carried out, with the exception that 3330 g of the mixture were placed in the hot air oven and the resultant dried wood pulp had a dry solid consistency of 85% by weight and a final pH of 8.9. The properties of the resultant sheets are shown in Table 1.

COMPARISON EXAMPLE 1

The same procedures as those mentioned in the Example 1 were carried out, except that no sodium sulfite and sodium hydroxide were used, and the resultant dried wood pulp prepared in the hot air oven had a dry solid consistency of 85% by weight, and a final pH of 6.1. The properties of the resultant sheets are shown in Table 1.

COMPARISON EXAMPLE 2

Procedures identical to those mentioned in Example 1 were carried out, except that 3330 g of the mixture were placed in the hot air oven and the resultant dried wood pulp had a dry solid consistency of 45%, and a final pH of 9.5. The properties of the resultant sheets are shown in Table 1.

COMPARISON EXAMPLES 3, 4 AND 5

In each of Comparison Examples 3, 4 and 5, the same procedures as those mentioned in Example 1 were carried out, except that a mixture having a dry solid consistency of 30% by weight of the wood pulp was heated in a closed autoclave, at a temperature of 130° C., for 15 minutes (Comparison Example 3), 30 minutes (Comparison Example 4) or 60 minutes (Comparison Example 5). The resultant heated wood pulp had a dry solid consistency of 30% by weight and a final pH of 8.9 (Comparison Example 3), 8.5 (Comparison Example 4) or 8.1 (Comparison Example 5). The properties of the obtained sheets in each comparison Examples are shown in Table 1.

EXAMPLE 3

The same procedures as those described in Example 1 were carried out, except that the drying operation of the mixture was effected by means of a flush dryer in which hot air having a temperature of 300° C. was blown, and the resultant dried wood pulp had a dry solid consistency of 85%, and a final pH of 9.0. The drying time was 30 seconds. The properties of the obtained sheets are shown in Table 1.

EXAMPLE 4

Pine wood chips were defibrillated in two stages by using a disc refiner and the resultant mechanical wood pulp was refined to produce mechanical wood pulp having a Canadian Standard freeness of 100 ml. The same procedures as those described in Example 1 were carried out by using the above-mentioned produced mechanical wood pulp, except that 3330 g of the mixture were placed in the hot air oven and the resultant product had a dry solid consistency of 85% by weight of the wood pulp, and a final pH of 8.8. The properties of the obtained sheets are shown in Table 1.

EXAMPLE 5

Procedures identical to those described in Example 1 were carried out, except that magnesium hydrogensulfite was used in place of the sodium sulfite, 3330 g of the mixture were placed in the hot air oven and the dried product had a dry solid consistency of 85% by weight of the wood pulp, and a final pH of 5.2. The properties of the obtained sheets are shown in Table 1.

EXAMPLE 6

Procedures identical to those mentioned in Example 1 were carried out, except that no sodium hydroxide was used, 3330 g of the mixture were placed in the hot air oven and the dried product had a dry solid consistency of 85% by weight of the wood pulp, and a final pH of 7.3. Table 1 shows properties of the obtained sheets.

EXAMPLE 7

The same procedures as those mentioned in Example 1 were carried out, except that 5% of sodium hydrogensulfite based on the dry solid weight of the wood pulp was used instead of 5% by weight of sodium sulfite and 1% by weight of sodium hydroxide, 3330 g of the mixture were placed in the hot air oven and the dried product had a dry solid consistency of 85% by weight of the wood pulp, and a final pH of 5.5. Table 1 shows properties of the obtained sheets.

EXAMPLE 8

Procedures identical to those mentioned in Example were carried out, except that the 5% by weight of sodium sulfite and the 1% by weight of sodium hydroxide were replaced by 2.5% by weight of sodium hydrogensulfite and 2.5% by weight of sulfurous acid, respectively, based on the dry solid weight of the wood pulp, 3330 g of the mixture were placed in the hot air oven, the dried product had a dry solid consistency of 85% by weight of the wood pulp, and a final pH of 3.2. The obtained sheets had the properties shown in Table 1.

Table 1

| Example | Dry solid consistency by weight of dried wood pulp (%) | Drying time (minute) | Final pH | Properties of obtained sheet: Bulk density (g/cm³) | Breaking length (Km) | Burst factor | Brightness (%) | Opacity (%) |
|---|---|---|---|---|---|---|---|---|
| Example 1 | 65 | 0.5 | 9.2 | 0.37 | 3.4 | 64 | 51 | 95 |
| Example 2 | 85 | 0.5 | 8.9 | 0.38 | 3.6 | 66 | 52 | 95 |
| Comparison Example 1 | 85 | 0.5 | 6.1 | 0.32 | 2.6 | 54 | 48 | 97 |
| Comparison Example 2 | (No sulfonating compound was used) | | | | | | | |
| Comparison Example 3 | 45 | 0.5 | 9.5 | 0.35 | 3.1 | 60 | 50 | 96 |
| Comparison Example 4 | 30 | 15 | 8.9 | 0.35 | 3.2 | 61 | 46 | 97 |
| Comparison Example 5 | 30 | 30 | 8.5 | 0.37 | 3.4 | 65 | 45 | 97 |
| Example 3 | 30 | 60 | 8.1 | 0.38 | 3.7 | 67 | 41 | 96 |
| Example 4 | 85 | 0.5 | 9.0 | 0.38 | 3.6 | 65 | 51 | 96 |
| Example 5 | 85 | 0.5 | 7.8 | 0.36 | 3.3 | 62 | 52 | 96 |
| Example 6 | 85 | 0.5 | 5.2 | 0.38 | 3.6 | 65 | 51 | 96 |
| Example 7 | 85 | 0.5 | 7.3 | 0.36 | 3.3 | 61 | 54 | 95 |
| Example 8 | 85 | 0.5 | 5.5 | 0.35 | 3.1 | 60 | 56 | 95 |
| | 85 | 0.5 | 3.2 | 0.35 | 3.1 | 60 | 57 | 96 |

In view of the results of Examples 1 and 2, and Comparison Examples 1 and 2, shown in Table 1, it is evident that the reaction rate of the sulfonating compound with the wood pulp increases as the drying process proceeds, and the increase in the dry solid consistency of the wood pulp and the sulfonating compound in the mixture, and that the mechanical strength of the wood pulp can increase without a decrease in the brightness of the wood pulp.

From the results of Comparison Examples 3 through 5, it is clear that in the reaction between the sulfonating compound and the wood pulp, the dry solid consistencies of which are maintained at 30% during the entire reacting period, a long reacting time of from 30 to 60 minutes is necessary to obtain the same increase in the mechanical strength of the dried wood pulp as that obtained in Examples 1 and 2. Further, it should be noted that the brightness of the wood pulp obtained in each of the Comparison Examples 3 through 5 is clearly poorer than that of Examples 1 and 2.

Table 1 also shows that the dried wood pulp obtained in each of Example 3 through 8 had increased mechanical strength and brightness in spite of the very short length of time of drying process.

What we claim is:

1. A process for simultaneously drying mechanical wood pulp fibers and improving the mechanical strength and brightness of said mechanical wood pulp fibers, comprising (1) mechanically refining wood chips to prepare mechanical wood pulp;

(2) mixing said mechanical wood pulp with an aqueous solution of at least one sulfonating compound;

(3) adjusting the dry solids consistency of said mechanical wood pulp in said mixture to a level of from 20 to 50% by weight, and;

(4) bringing said adjusted mixture into contact with a drying gas heated to a temperature above 100° C. for a time sufficient to increase the dry solid consistency of said mechanical wood pulp in said mixture to a level of from 60 to 90% by weight.

2. A process as claimed in claim 1, wherein said sulfonating compound is selected from the group consisting of sulfurous acid, water-soluble sulfites, hydrogensulfites and pyrosulfites.

3. A process as claimed in claim 1, wherein said aqueous solution contains at least one buffer agent selected from the group consisting of hydroxides, carbonates and hydrogencarbonates of ammonium, alkali metals and alkaline earth metals.

4. A process as claimed in claim 1, wherein said mixture contains said sulfonating compound in a dry solid consistency of from 20 to 50% based on the weight of said mixture.

5. A process as claimed in claim 1, wherein said mixture contains said sulfonating compound in a dry solid consistency of from 1 to 15% based on the dry solids weight of said mechanical wood pulp.

6. A process as claimed in claim 1, wherein the temperature of said heating gas is in a range of from 120° to 500° C.

7. A process as claimed in claim 1, wherein said drying operation is carried out for a period not longer than 5 minutes.

8. A process as claimed in claim 1, wherein said heating gas is selected from the group consisting of hot air, waste gas of a boiler and burnt heavey oil gas.

9. A process as claimed in claim 1, wherein said drying operation is effected in a hot air oven or a flush dryer.

10. A process as claimed in claim 1, wherein said aqueous solution of said sulfonating agent has a pH of from 2 to 13.

11. A process as claimed in claim 1, wherein at the final stage of the drying operation, the pH of the resultant product is not higher than 9.

* * * * *